United States Patent [19]

Deluty

[11] 4,114,875

[45] Sep. 19, 1978

[54] FRICTION TYPE EXERCISING DEVICE

[76] Inventor: Michael E. Deluty, 37 Addington Rd., Brookline, Mass. 02146

[21] Appl. No.: 782,468

[22] Filed: Mar. 29, 1977

[51] Int. Cl.[2] ..... A63B 21/00

[52] U.S. Cl. ..... 272/133; 188/65.1; 272/140

[58] Field of Search ..... 272/140, 133, 138, DIG. 3, 272/DIG. 4, 135; 188/65.1; 182/10, 11

[56] References Cited

U.S. PATENT DOCUMENTS

| | | | |
|---|---|---|---|
| 3,596,907 | 8/1971 | Brighton | 272/140 X |
| 3,756,565 | 9/1973 | Sakai | 188/65.1 X |
| 3,885,789 | 5/1975 | Deluty et al. | 272/133 |
| 3,957,118 | 5/1976 | Barry et al. | 188/65.1 X |

*Primary Examiner*—William R. Browne

*Attorney, Agent, or Firm*—Thompson, Birch, Gauthier & Samuels

[57] ABSTRACT

An exercising device having a housing which is attached to a stationary surface. A cord with a hand grip on its free end can be pulled out of the housing against the internal resistance of the exercising device. The amount of internal resistance can be varied by control knobs. An automatic rewind mechanism draws the cord back into the housing when the cord is released. The device has, as a preferred specific feature, a manually adjustable resisting force mechanism.This mechanism has a straight surface which is contacted and engaged by the cord over the full length of the straight surface. This mechanism includes the preferred combination of a stationary capstan around which the cord is wrapped, and a variable force friction nip mechanism which (a) retards the cord as it is pulled out of the housing, and (b) maximizes the capstan's frictional resistance by keeping the cord tightly wound around the capstan as the cord is being pulled out of the housing. A limit stop is provided for limiting the travel of the cord engaging wedge member toward the cord; and a limit stop is also provided to limit the travel of the cord-contacting support member towards and away from the cord. The wedge member moves in a guide during its reciprocation, and the wedge member engages the cord on the cord support surface at less than 90°.

5 Claims, 3 Drawing Figures

FRICTION TYPE EXERCISING DEVICE

BACKGROUND OF THE INVENTION

This invention is a variation of my previous exercising device shown in U.S. Pat. No. 3,885,789. In particular, this invention has as its object the provision of an exercising device which is a simple mechanism, which is inexpensive to construct, and which employs a wedging means to produce a friction nip on the pull cord.

A further object of this invention is to provide an exercising device on which the operator can manually select a variety of specific pull cord resistance force levels.

A still further object of this invention is to provide an exercising device which the operator can utilize in a true exercising motion as if he were lifting a barbell or a dumbbell.

SUMMARY OF THE INVENTION

The exercising device of the preferred embodiment of this invention has a hollow housing in which a rotatably mounted retractor reel is spring-loaded in the rewind direction. A flexible cord is attached to the retractor reel and extends out of the housing where it is fitted with a hand grip. When little or no pulling force is exerted by the operator on the hand grip, the retractor reel rewinds the cord into the housing.

When the operator pulls on the hand grip, the outward pulling force on the cord is resisted by a combination of three mechanisms mounted within the housing. These mechanisms can be manually adjusted to produce various levels of resistance. The first resisting mechanism is the retractor reel which continuously produces a small biasing force on the cord in the rewind direction.

The other two mechanisms resisting the outward pull of the cord both operate to apply friction force to the cord as it is being pulled out (unwound) by the operator and both apply no significant friction force to the cord as it is being rewound by the retractor reel. The friction nip mechanism has a spring-loaded support member and an opposed spring-loaded wedge member which cooperate to form a nip through which the cord is led from the retractor reel. The spring tension on the support member can be manually adjusted by the operator to vary the force applied by the nip on the cord in opposition to the exteriorly applied pulling force on the cord's hand grip.

After the cord passes from the retractor reel through the friction nip mechanism, it is led to and is looped around the optional capstan, and then is led out of the housing. The capstan can be locked into a stationary condition to oppose the cord's being pulled out of the housing, or it can be unlocked and allowed to freewheel as the cord is being pulled out of the housing. In either locking condition, the capstan is allowed to freewheel in the rewind direction. Because the capstan is relatively inefficient unless the cord around the capstan is pulled to some extent in both directions, the friction nip mechanism has the dual function of exerting a drag on the cord on the rewind side of the capstan to increase the efficiency of the capstan, as well as exerting a drag on the cord to frictionally resist the outward pull on the cord.

It will be appreciated that at all times the retractor reel urges the cord in the rewind direction whereas the friction nip mechanism and the capstan apply no significant friction force on the cord as it rewinds. Furthermore, at all times the friction nip mechanism applies frictional force on the cord to resist its being pulled out of the housing by the operator. Finally, at selected times the capstan can be locked into its operative locked stationary condition to cooperate with the friction nip mechanism and the retractor reel so that all three act upon the cord to resist its being pulled out of the housing by the operator.

DESCRIPTION OF THE PREFERRED EMBODIMENT

Figure 1:
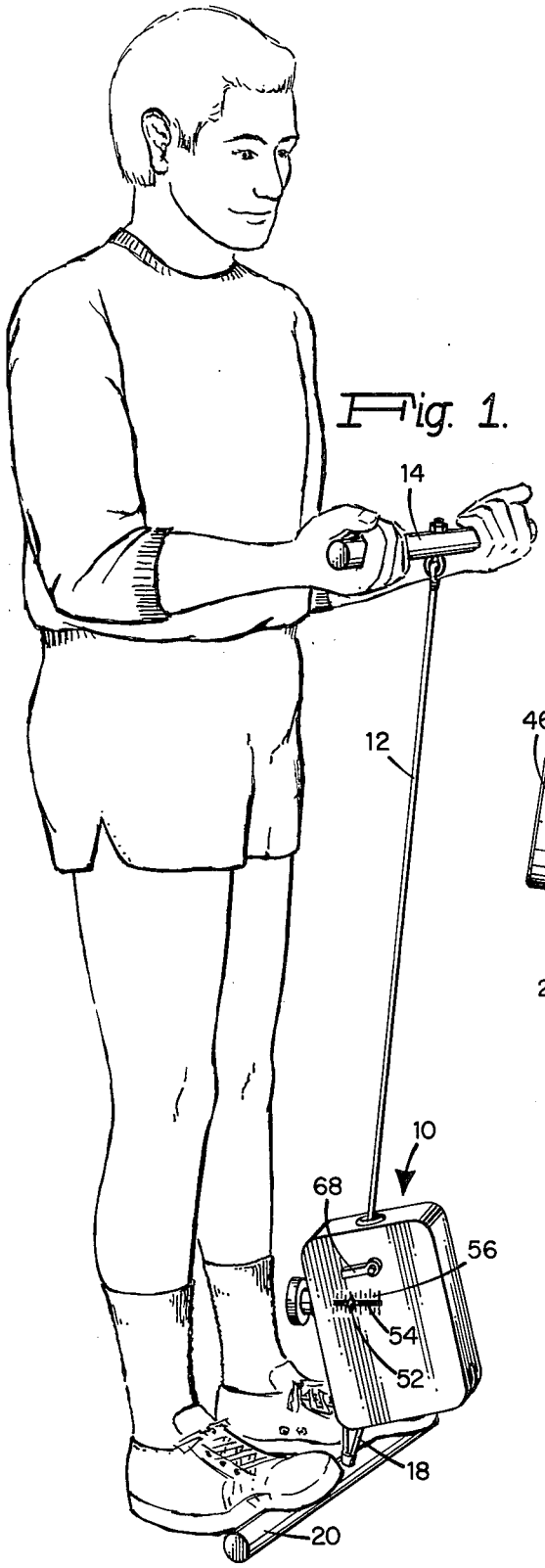
FIG. 1 is a perspective view of the exercising device of the preferred embodiment of this invention showing an operator holding the hand grip and pulling the cord out of the housing.

FIG. 1 shows a human operator performing a curling exercise with the exercising device 10 of this invention. The curling exercise is usually performed with a barbell and it is the purpose of FIG. 1 to show one example of how exercising device 10 can be substituted for a barbell in weight training. The operator simply dials the desired "weight" setting on the device and then uses the exercising device as if it were a barbell weighing the dialed amount.

Exercising device 10 is provided with a flexible pull cord 12, preferably made of nylon, and a detachable hand grip 14. Various different types of hand or other grips can be attached to the end of cord 12 in order to meet the requirements of various exercise routines. Examples of different grips include double grips, bar grips, loop grips, grips to fit the operator's head, and grips to fit the operator's feet. The exercising device of this invention is not limited to any specific type of grip attached to the end of pull cord 12.

In order to hold the exercising device 10 in a stationary position (which is usually preferred), the exercising device is provided with various fittings, such as interior stanchions 16 (see FIG. 2) over which the eye of a short length of line 18 can be looped. Line 18 can then be attached to a foot rest 20, or to a wall fitting, or to a ceiling fitting, or to other fixed supports. It will be understood that a wide variety of such fittings is contemplated and this invention is not limited to any specific type or location of fitting, or any specific type or location of line, or any specific type or location of foot rest or other fixed support.

Figure 2:
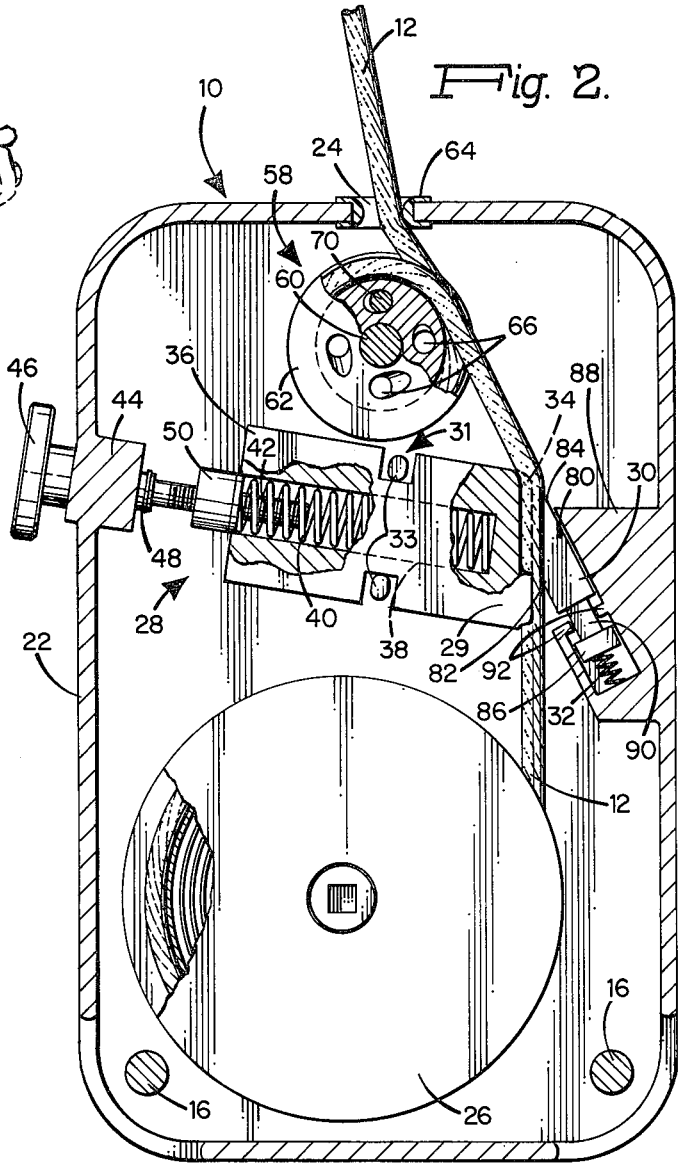
FIG. 2 is a magnified view of the preferred embodiment of the exercising device showing the housing interior and the mechanisms mounted therein, the mechanisms being partially cut away for purposes of clarity.

Referring now to FIG. 2, it will be seen that the exercising device 10 has a hollow housing 22 which has a cord opening 24 through which pull cord 12 extends. The outer end of cord 12 is fitted with hand grip 14 and the inner end of cord 12 is fixed to and is wrapped several times around retractor reel 26. Retractor reel 26 is rotatably mounted in the housing and is spring-powered in the clockwise or rewind direction. Preferably, retractor reel 26 exerts a continuous rewind force on the cord of approximately 2 to 6 lbs. Thus, whenever the operator releases hand grip 14, or exerts less than the retractor reel rewind force, cord 12 will be drawn into housing 22 through opening 24 and will be rewound on reel 26. The size of hand grip 14 prevents the outer end of cord 12 from being drawn entirely into housing 22 through opening 24.

In order to provide a substantial force against cord 12 which will resist the operator's outward pull on the cord, a manually adjustable variable resistance means is mounted within the housing between retractor reel 26 and housing cord opening 24. In the shown preferred embodiment of FIG. 2, this variable resistance means is more specifically identified as a friction nip means which includes a support member 28, which contacts one side of cord 12, and a wedging means including a wedge member 30, which is urged by spring 32 against the other side of cord 12. The purpose of the friction nip means is to apply frictional force against the cord as it is pulled in the unwind (outward) direction only. This frictional force must be overcome by the operator in order to pull the cord out of the housing. Furthermore, this frictional force is necessary to enable the capstan to operate effectively in its locked stationary condition, as will be described subsequently.

Support member 28 can take various forms. In the preferred embodiment shown in FIG. 2, support member 28 has a leading straight cord-contacting portion 29 having a grooved shoulder surface 34 which bears concentrically against and guides the cord 12 as the cord passes from retractor reel 26 through cord opening 24. Support member 28 also has a trailing portion 36 having unshown guide ribs on one exterior side which ride on mating guide ribs which are provided on the adjacent interior wall of housing 22. By this arrangement, support member 28 can be reciprocated towards and away from cord 12 along a guide path which intersects with the cord at an angle of approximately 80° relative to the portion of the cord leading to cord opening 24. Obviously, other types of guide means can be substituted for the unshown mating guide ribs. The support member 28 is provided with a pair of recesses 31, and the interior wall of housing 22 is provided with a pair of stops 33 in order to limit support member reciprocating travel.

Figure 3:
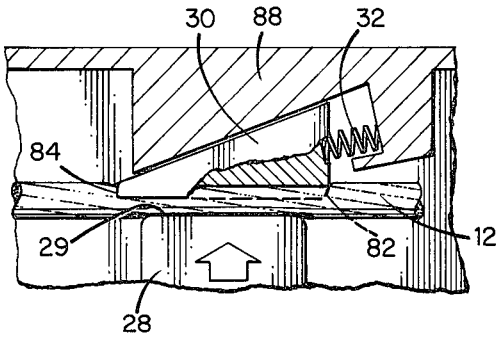
FIG. 3 is a view of an alternate embodiment of the wedging means.

In the alternate embodiment shown in FIG. 3, support member 28 has a leading straight cord-contacting portion 29 having a planar (flat) shoulder surface 34 which bears against cord 12. The support member utilizes unshown guide means for reciprocation with limits towards and away from cord 12 along a guide path which is perpendicular to the cord.

Support member trailing portion 36 has a spring socket 38 formed therein. A helical compression spring 40 is positioned in socket 38 and is retained therein by threaded shaft 42. The shaft is carried by a smooth-bored shaft support block 44 which is formed on the interior wall of housing 22, and a control knob 46 is fixed on the exterior end of shaft 42. A collar 48 is mounted on shaft 42 to prevent axial movement of the shaft while permitting the shaft to be rotated by the control knob.

A floating nut 50 is provided with internal threads which mesh with the external threads on shaft 42. An indicating arrow 52 is fixed to floating nut 50 and extends through housing slot 54. Because the indicating arrow 52 is confined within slot 54, nut 50 cannot rotate when shaft 42 is rotated. Instead, when control knob 46 is rotated, shaft 42 is rotated, and nut 50 moves axially on shaft 42. This causes indicating arrow 52 to move along slot 54 and across weight dial 56 (as shown in FIG. 1).

It will be seen that as nut 50 compresses spring 40, the support member 28 is forced towards the wedge member 30 in the nip. Likewise, as nut 50 releases the pressure on spring 40, the support member 28 moves away from wedge member 30 in the nip. During this axial nut movement, indicating arrow 52 moves across weight dial 56 which is calibrated to indicate, for example, 0 to 50 lbs. nip resistance force on the cord which must be overcome by the operator in order to pull the cord out of the housing. Thus, the operator, by turning control knob 46, can set the level of nip resistance which he wants the exercising device to exert againt his pull on the cord.

The wedge member 30 can take various forms. In the preferred embodiment shown in FIG. 2, wedge member 30 has a cord-engaging substantially smooth and toothless leading end 80 which is provided with an upstream portion 82 a downstream portion 84, and a central portion therebetween. The upstream portion 82 is the wedge member component which contacts cord 12 nearest retractor reel 26. The downstream portion 84 is the wedge member component which contacts cord 12 nearest cord opening 24. Portions 82 and 84 must be appropriately shaped so as not to be too sharp or too smooth. The leading end 80 may be concentrically grooved relative to the cord (see FIG. 3), or may be planar and parallel to the support member (see FIG. 2), or may be any combination thereof. Preferably, the entire surface of leading end 80 engages cord 12, but this is not an absolute requirement.

Upstream portion 82 acts as an initial engagement portion and should be sufficiently sharp or irregular to cause the wedge member 30 to become caught up with and to be dragged towards cord 12 within limits as the cord is initially pulled out of opening 24. Upstream portion 82 should also be sufficiently smooth or regular to cause the wedge member 30 to release and to permit the cord to frictionally slide under the wedge member as the cord thereafter continues to be pulled out of opening 24.

Conversely, downstream portion 84 should be sufficiently sharp or irregular to cause the wedging member 30 to become caught up with and to be dragged away from cord 12 as the cord is initially retracted into opening 24. Downstream portion 84 should also be sufficiently smooth or regular to cause the wedge member 30 to release and to permit the cord to frictionally slide under the wedge member as the cord thereafter continues to be retracted into opening 24.

Wedge member 30 has a trailing end 86 against which compression spring 32 is urged. Wedge member 30 is mounted in guide means 88 for reciprocating travel towards and away from cord 12 along a guide path which intersects with the cord at an angle of approximately 35° relative to the portion of the cord leading to the retractor reel 26.

Wedge member 30 is provided with a circumferential groove 90, and the interior walls of guide means 88 are provided with stops 92, in order to limit wedge member reciprocating travel. The shape of wedge member 30 can vary. FIGS. 2 and 3 show two possible shapes.

The nip formed between support member 28 and wedge member 30 exerts significant frictional force on the cord only during the outward (unwind) travel of the cord through the nip. This is because the wedge member 30 is dragged into an embedded position deforming and frictionally retarding the surface of the cord as the cord is pulled out of the housing. However, the wedge member is dragged out of its embedded position as the cord is retracted into the housing causing the wedge member to become ineffective as a nip-forming component during the rewinding travel of the cord. The cord can be alternately pulled out and rewound back numerous times without becoming jammed in the nip because a relatively loose fit exists between the guide surfaces on the support member 28 and the guide surfaces on the interior housing wall. Thus, there is considerable support member lateral play which facilitates easy nip opening.

Accordingly, if the operator wishes to pull against say 35 lbs. of resistance, he turns control knob 46 until the indicating arrow 52 aligns with the 35 lb. weight marking on dial 56. This means that nut 50 has compressed spring 40 the sufficient distance to achieve a 35 lb. nip pressure against the cord 12. When the cord is pulled outwardly, the wedge member 30 wedges cord 12 against support member 28 to produce the desired nip frictional resistance. When the operator releases the cord, the nip opens because wedge member 30 retracts, and cord 12 rewinds on retractor reel 26.

A second and entirely optional substantial cord resistance force is provided by the capstan which is generally indicated as 58. The capstan has an inoperative mode in which it freewheels in both directions and an operative mode in which it is locked so as to remain stationary in the outward or unwind direction (counter-clockwise in FIG. 2). Capstan 58 has a fixed central shaft 60 mounted in the housing parallel to the central shaft of retractor reel 26. A flanged spool 62 is rotatably mounted on central shaft 60 and can revolve in either direction. A collar 64 is affixed to cord opening 24 to guide cord 12 from capstan 58 and out of opening 24.

In the previously given 35 lb. resistance example, the capstan was assumed to have been in its inoperative mode in which it freewheeled in both directions and functioned simply as a guide roller.

When it is desired to substantially increase the resistance exerted by the exercising device against pull cord 12, the capstan 58 is locked into its operative mode. Capstan spool 62 is provided with four symmetrically spaced locking recesses 66 in its upper flat end surface. A locking lever 68 is mounted in housing 22 and can be pivoted between an inoperative position which maintains spring-loaded locking pin 70 above the locking recesses 66, and an operative position which lowers locking pin 70 into one of the four locking recesses 66. Once the locking pin 70 is lowered into any of the sloping locking recesses 66, the capstan spool 62 cannot rotate in the counter-clockwise direction about shaft 60. However, spool 62 can easily rotate in the clockwise direction in ratchet-fashion. A plurality of sloping recesses 66 is provided simply for ease of locking. A greater or lesser number of recesses would also be satisfactory.

It is preferred to wrap cord 12 two and one-half turns around spool 62. Then, if the friction nip applies 35 lbs. of force against the outward pull of the cord, the locked capstan will multiply the resistance force by a factor of approximately ten so that the operator must exert a force of approximately 350 lbs. on the hand grip in order to pull cord 12 out of the housing. Obviously, many factors will affect the exact multiplying ratio produced by the capstan. Examples of these factors include the diameter of the capstan, the capstan surface roughness, the diameter of the cord, the cord material, the number of turns on the capstan, and numerous others. However, regardless of the exact multiplying ratio, the capstan will produce a substantial resistance force opposing the passage of the cord out of the housing.

As previously indicated, the capstan cannot provide maximum frictional resistance against the cord unless the cord is held tightly against the spool from both directions. For this reason, maximum performance capstan operation requires the resistance produced by the friction nip. Preferably, the capstan is provided with a ratcheting mechanism wherein the spool is fixed against rotation in the unwind or outward direction, yet is permitted to freely rotate in the rewind or inward direction. However, instead of a ratcheting mechanism, many types of clutch mechanisms could be substituted to accomplish the same purpose.

In operation, when the operator desires to set the cord resistance force at a high level, he pivots locking lever 68 to the locked position and pulls cord 12 outwardly a short distance to rotate spool 62 until locking pin 70 drops into one of the locking recesses 66. This locks the capstan in its operative mode. Then, the operator twists control knob 46 to set the spring compression on the friction nip at the level which he desires as shown by the indicator arrow 52 on dial 56. Dial 56 is calibrated and marked so that one set of dial figures reflects the resistance force settings when the capstan is in its inoperative mode. A second set of parallel dial figures reflects the resistance force settings when the capstan is in its operative mode. In the preferred embodiment, the upper figures (operative mode) are a multiple of ten times the lower figures (inoperative mode). Thus, in the example used thus far, the arrow would read 35 lbs. on the lower dial figures and 350 lbs. on the upper dial figures. Of course, other resistance force level indicating arrangements could be provided to perform the same function as the illustrated arrangement.

This invention features a great ease of adjustability whereby the operator can set the cord resistance force levels across a very wide range by locking or unlocking the optional capstan and by dialing the desired spring tension on the nip.

The above description obviously suggests many possible variations and modifications of this invention which would not depart from its spirit and scope. It should be understood, therefore, that the invention is not limited in its application to the details of structure specifically described or illustrated and that within the scope of the appended claims, it may be practiced otherwise than as specifically described or illustrated.

I claim:

1. In an exercising device including:

(a) a housing having a hollow interior and a cord opening;

(b) a cord retractor reel mounted for rotation within said housing;

(c) rewind means for continuously urging said retractor reel in the rewind direction;

(d) a flexible deformable cord fixed to and wrapped around said retractor reel, said cord running from said reel out of said housing through said cord opening; and (e) manually adjustable variable resistance friction nip means mounted within said housing between said cord retractor reel and said cord opening for applying frictional force to said cord, said friction nip means including a support member contacting one side of said cord, wedging means mounted on the other side of said cord, first resilient means for continuously urging the wedging means against the other side of said cord to frictionally wedge said cord between said support member and said wedging means as said cord is pulled out of said housing, said wedging means retracting to unwedge said cord as said cord is retracted into said housing;

(f) said rewind means and said variable resistance friction nip means both cooperating to apply force to said cord to oppose an exteriorly applied manual force pulling said cord in the unwind direction, said friction nip means releasing force on said cord, and said rewind means retracting said cord in the rewind direction in the absence of an exteriorly applied manual force on said cord; and (g) an improvement to said nip means comprising:

(i) said support member having only a straight cord-contacting surface, said cord only contacting said straight surface over its entire length, and stop means for limiting the travel of said support member in directions towards and away from said cord;

(ii) said wedging means including a wedge member having a substantially smooth and toothless leading portion contacting and frictionally wedging said cord between said wedge member and said straight cord-contacting surface of said support member, said wedge member leading portion engaging and deforming said cord and thereby frictionally retarding the unwinding movement of said cord; and (iii) said wedging means further including guide means for permitting said wedge member to longitudinally reciprocate along a straight path which intersects with said straight cord-contacting surface of said support member at an angle less than 90°, said guide means including means for limiting and positively halting wedge member travel towards said cord.

2. The exercising device of claim 1 wherein said first resilient means is a compression spring.

3. The exercising device of claim 1 further including second means for resiliently urging said support member and said wedge member towards each other.

4. The exercising device of claim 3 wherein said second resilient means is a compression spring, said spring being manually variably preloaded to urge said support member against said cord.

5. The exercising device of claim 3 wherein said support member is urged along a guide path which intersects with said one side of said cord at an angle of less than 90° relative to the portion of said cord leading to said cord opening.

* * * * *